US007210944B1

(12) United States Patent
Chang et al.

(10) Patent No.: US 7,210,944 B1
(45) Date of Patent: May 1, 2007

(54) CONNECTOR

(75) Inventors: Yi-Yu Chang, Chung Ho (TW); Chun-Hsu Chen, Chung Ho (JP)

(73) Assignee: Jess-Link Products Co., Ltd., Taipei County (TW)

( * ) Notice: Subject to any disclaimer, the term of this patent is extended or adjusted under 35 U.S.C. 154(b) by 0 days.

(21) Appl. No.: 11/320,876

(22) Filed: Dec. 30, 2005

(51) Int. Cl.
*H01R 13/405* (2006.01)

(52) U.S. Cl. ..... 439/76.1; 439/736; 439/606

(58) Field of Classification Search ..... 439/76.1, 439/736, 606, 604
See application file for complete search history.

(56) References Cited

U.S. PATENT DOCUMENTS 3,951,492 A * 4/1976 Braund ..... 439/76.1
4,030,799 A * 6/1977 Venaleck ..... 439/405
4,579,404 A * 4/1986 Lockard ..... 439/92
4,826,443 A * 5/1989 Lockard ..... 439/101
5,679,008 A * 10/1997 Takahashi et al. ..... 439/76.1
6,585,528 B1 * 7/2003 Lin et al. ..... 439/76.1
6,758,694 B2 * 7/2004 Liu ..... 439/606
6,764,336 B2 * 7/2004 Ma et al. ..... 439/604
6,776,658 B2 * 8/2004 Tang ..... 439/607
6,790,087 B2 * 9/2004 Ho ..... 439/606
6,994,594 B2 * 2/2006 Milner et al. ..... 439/676
2006/0014430 A1 * 1/2006 Liang et al. ..... 439/606

* cited by examiner

*Primary Examiner*—Gary Paumen
(74) *Attorney, Agent, or Firm*—Rosenberg, Klein & Lee

(57) ABSTRACT

A connector for electrically connecting to a mating connector has a circuit board, a cable, and a support member. The circuit board has a front portion, a mid portion, and a rear portion. The front portion has a plurality of conductive pads for electrically contacting electrical portions of the mating connector. The rear portion has a plurality of soldering pads. The cable has a plurality of wires. The wires are soldered onto the soldering pads. The mid portion and the rear portion of the circuit board are embedded into the support member via a manner of insert-molding. As a result, the circuit board will not loosen from the support member, and the connection between the soldering pads of the circuit board and the wires of the cable is reliable.

8 Claims, 3 Drawing Sheets

CONNECTOR

BACKGROUND OF THE INVENTION

1. Field of the Invention

The present invention relates to a connector, and more particularly, to an electrical connector.

2. Background of the Invention

There are many types of electrical connectors that are widely used in electronic products. For example, a high-frequency connector is an indispensable component for a communication product.

A conventional connector includes a printed circuit board and a plastic member. The printed circuit board has an insertion portion. The plastic member has an opening and two protection plates. Each of the protection plates has an insertion slot. The printed circuit board is inserted into the insertion slots. The insertion portion of the printed circuit board penetrates through the opening of the plastic member for electrically contacting electrical portions of a mating connector.

The structure of the plastic member of the above conventional connector is complicated. An assembling process of the printed circuit board and the plastic member is a necessity to obtain the above connector. As a result, the cost of the above connector is increased. In addition, the printed circuit board is inserted into the insertion slots, but it is not reliably connected to the plastic member. As a result, when the connector is connected to the mating connector, the printed circuit board becomes loose. Consequently, the electrical contact between the connector and the mating connector is unstable.

SUMMARY OF INVENTION

The primary object of the invention is therefore to specify a connector, in which a circuit board thereof is reliably connected to a support member thereof, so as to prevent the circuit board from loosening from the support member and to decrease the cost thereof.

Another object of the invention is therefore to specify a connector, in which the connection between soldering pads of a circuit board thereof and wires of a cable thereof is reliable.

According to the invention, the object is achieved via a connector for electrically connecting to a mating connector. The connector comprises a circuit board, a cable, and a support member. The circuit board has a front portion, a mid portion, and a rear portion. The front portion has a plurality of conductive pads for electrically contacting electrical portions of the mating connector. The rear portion has a plurality of soldering pads. The cable has a plurality of wires. The wires are soldered onto the soldering pads. The mid portion and the rear portion of the circuit board are embedded into the support member via a manner of insert-molding.

By using insert-molding, the circuit board is reliably and simply connected to the support member, so as to prevent the circuit board from loosening from the support member, and to decrease the cost of the connector of the present invention as well.

In addition, the support member surrounds the rear portion of the circuit board, so that the connection between the soldering pads of the circuit board and the wires of the cable is reliable.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention which will be described hereinafter and which will form the subject of the claims appended hereto.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE EMBODIMENTS

Figure 1:
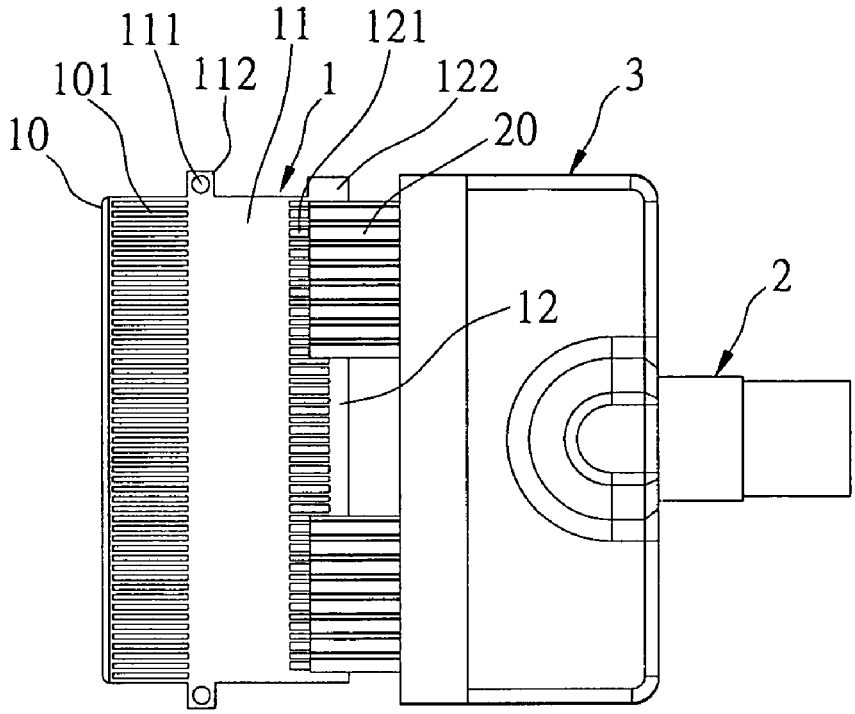
FIG. 1 is an upward view showing wires of a cable of a connector of the present invention being soldered onto soldering pads of a circuit board of the connector of the present invention.
Figure 2:
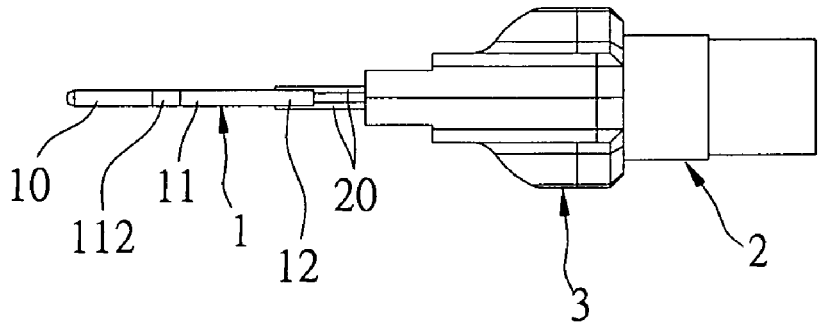
FIG. 2 is a side view showing wires of a cable of a connector of the present invention being soldered onto soldering pads of a circuit board of the connector of the present invention.

Referring to FIGS. 1–6, the present invention provides a connector for electrically connecting to a mating connector (not shown). The connector comprises a circuit board 1, a cable 2, a wire-arrangement member 3, and a support member 4.

The circuit board 1 has a front portion 10, a mid portion 11, and a rear portion 12. The front portion 10 has a plurality of conductive pads 101 disposed on a surface thereof for electrically contacting electrical portions of the mating connector. The rear portion 12 has a plurality of soldering pads 121 disposed on a surface thereof. The mid portion 11 and the rear portion 12 may further have electronic components (not shown).

The cable 2 has a plurality of wires 20.

The wire-arrangement member 3 is made of insulative material (such as a soft plastic). A part of each of the wires 20 of the cable 2 is embedded into the wire-arrangement member 3 via a manner of insert-molding. As such, a distal end of each of the wires 20 aligns with a corresponding soldering pad 121 of the circuit board 1. In this embodiment, the rear portion 12 of the circuit board 1 has a protrusion 122 extending outward from one lateral edge thereof. The protrusion 122 indicates a direction of the circuit board 1, so that the wires 20 are capable of being soldered onto the soldering pads 121 correctly.

The support member 4 is made of insulative material (such as a soft plastic). The mid portion 11 and the rear portion 12 of the circuit board 1 are embedded into the support member 4 via a manner of insert-molding. As such, the circuit board 1 is reliably and simply connected to the support member 4, and the soldering pads 121 and the distal ends of the wires 20 are protected by the support member 4. In addition, the support member 4 has a flange 40. The flange 40 has a notch 401 close to one lateral edge of the support member 4. As such, a casing (not shown) is assembled onto the support member 4 correctly.

Figure 3:
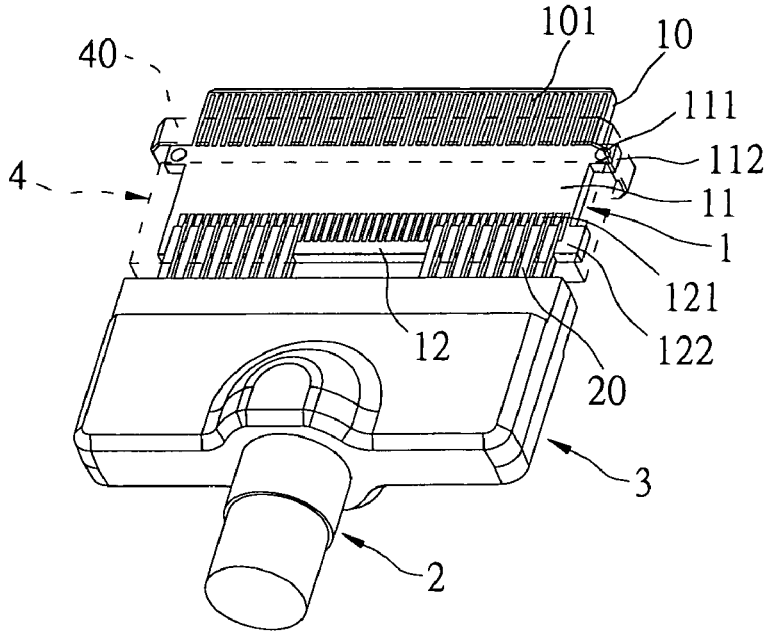
FIG. 3 is a perspective view of a connector of the present invention.
Figure 6:
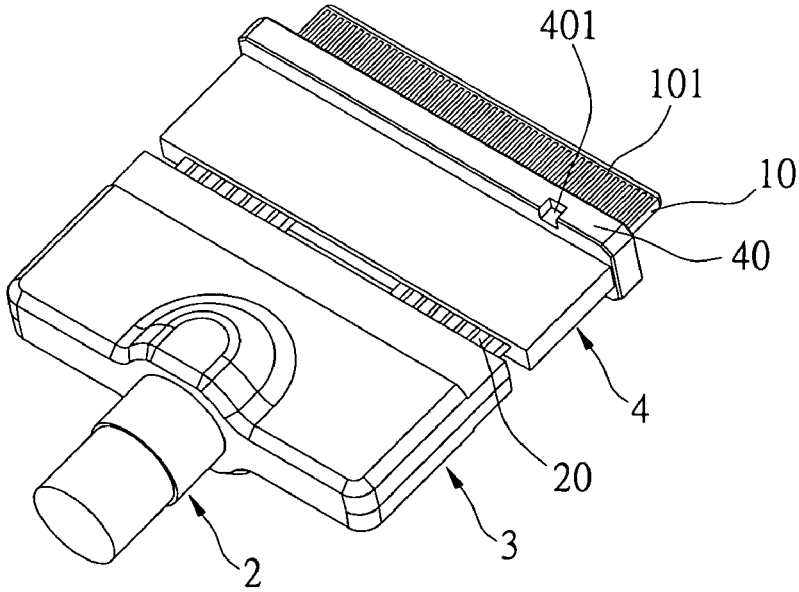
FIG. 6 is another perspective view of a connector of the present invention.
Figure 4:
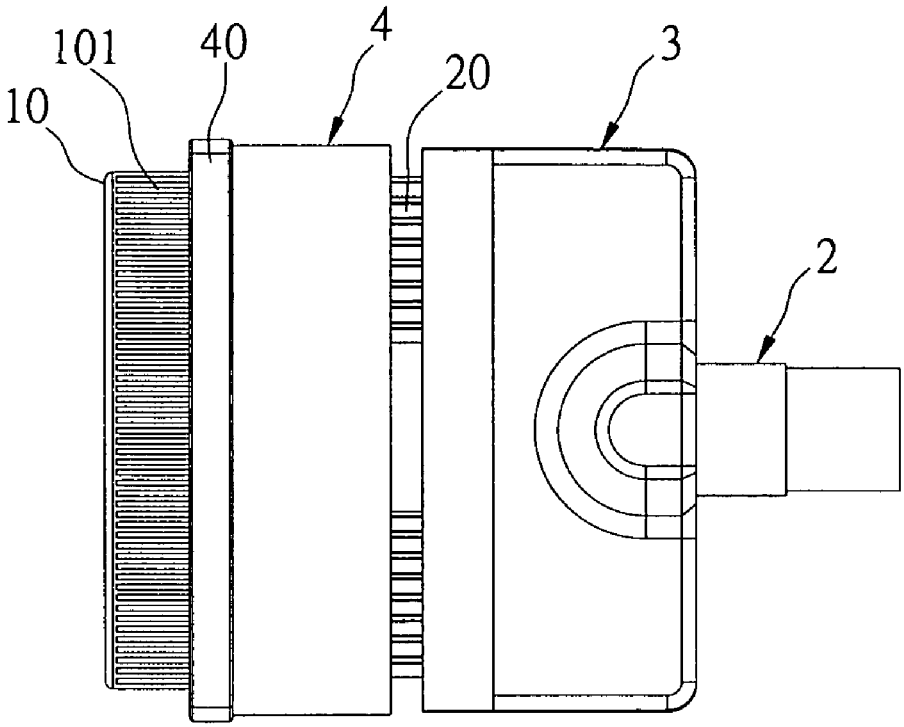
FIG. 4 is an upward view of a connector of the present invention.
Figure 5:
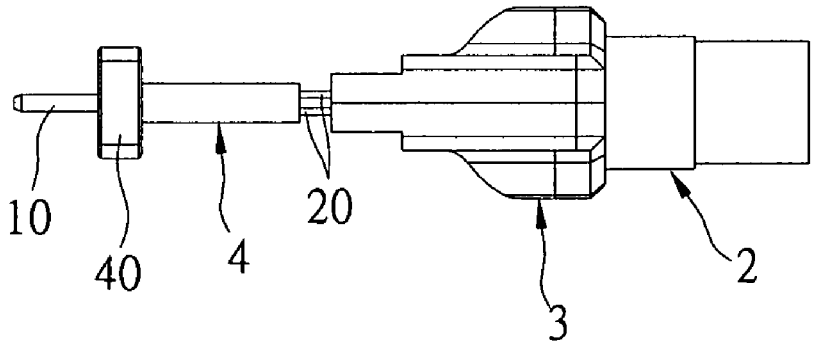
FIG. 5 is a side view of a connector of the present invention.

Moreover, the mid portion 11 of the circuit board 1 may have at least one through hole 111. As shown in FIGS. 1 and 3, the mid portion 11 of the circuit board 1 has two through holes 111 respectively disposed in two lateral edges thereof. A part of the support member 4 is formed in the through holes 111, so that the circuit board 1 is reliably connected to the support member 4.

Furthermore, the mid portion 11 of the circuit board 1 may have at least one wing portion 112 extending outward from one lateral edge thereof. The at least one wing portion 112 has a through hole 111. As shown in FIGS. 1 and 3, the mid portion 11 of the circuit board 1 has two wing portions 112 respectively and symmetrically extending outward from two lateral edges thereof. Each of the wing portions 112 has a through hole 111. The wing portions 112 are embedded into the support member 4, and a part of the support member 4 is formed in the through holes 111, so that the circuit board 1 is reliably connected to the support member 4.

The connection between the circuit board 4 and the support member 4 is firm. Therefore, when the connector of the present invention is connected to the mating connector, the circuit board 1 will not become loose, so that the electrical contact between the conductive pads 101 of the circuit board 1 and the electrical portions of the mating connector is stable.

As indicated above, the connector of the present invention has the following advantages:

1. By using insert-molding, the circuit board is reliably connected to the support member, so as to prevent the circuit board from loosening from the support member. Therefore, the electrical contact between the connector of the present invention and the mating connector is stable.

2. By using insert-molding, the circuit board is simply connected to the support member, so as to decrease the cost of the connector of the present invention.

3. The support member surrounds the rear portion of the circuit board, so that the connection between the soldering pads of the circuit board and the wires of the cable is reliable.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A connector for electrically connecting to a mating connector comprising:

a circuit board having a front portion, a mid portion, and a rear portion, the front portion having a plurality of conductive pads for electrically contacting electrical portions of the mating connector, the mid portion of the circuit board having at least one wing portion extending outward from one lateral edge thereof and the at least one wing portion having a through hole, and the rear portion having a plurality of soldering pads;

a cable having a plurality of wires, and the wires being soldered onto the soldering pads; and a support member; wherein the mid portion and the rear portion of the circuit board are embedded into the support member by insert-molding.

2. The connector as claimed in claim 1, wherein the mid portion of the circuit board has two wing portions respectively and symmetrically extending outward from two lateral edges thereof, and each of the wing portions has a through hole.

3. The connector as claimed in claim 1, wherein the circuit board has a protrusion extending outward from one lateral edge thereof.

4. The connector as claimed in claim 1, wherein the support member has a flange, and the flange has a notch close to one lateral edge of the support member.

5. The connector as claimed in claim 1, comprising a wire-arrangement member, wherein a part of each of the wires of the cable is embedded into the wire-arrangement member by insert-molding, and each of the wires aligns with a corresponding soldering pad of the circuit board.

6. A connector for electrically connecting to a mating connector comprising:

a circuit board having a front portion, a mid portion, and a rear portion, the front portion having a plurality of conductive pads for electrically contacting electrical portions of the mating connector, and the rear portion having a plurality of soldering pads;

a cable having a plurality of wires, the wires being soldered onto the soldering pads;

a support member formed of insulative material to embed the mid portion and the rear portion of the circuit board and a distal end of the wires therein; and a wire-arrangement member formed of insulative material to embed the wires therein so as to be in alignment with a corresponding soldering pad of the circuit board, the wire-arrangement member and the support member being mutually distinct insulative formations on the wires and separated one from another.

7. The connector, as claimed in claim 6, wherein solder pads of the circuit board are aligned with the wires in accordance with a protrusion extending outward from one lateral edge of the circuit board.

8. The connector as claimed in claim 6, wherein the support member includes a flange having a notch close to one lateral edge thereof.

* * * * *

UNITED STATES PATENT AND TRADEMARK OFFICE

CERTIFICATE OF CORRECTION

PATENT NO. : 7,210,944 B1
APPLICATION NO. : 11/320876
DATED : May 1, 2007
INVENTOR(S) : Yi-Yu Chang et al.

It is certified that error appears in the above-identified patent and that said Letters Patent is hereby corrected as shown below:

IN THE TITLE PAGE:

Item [75] Delete the nationality "(JP)" of Chun-Hsu Chen and insert --(TW)--.

Signed and Sealed this

Twenty-fourth Day of July, 2007

JON W. DUDAS
*Director of the United States Patent and Trademark Office*